US008494195B2

(12) United States Patent
Higgins

(10) Patent No.: US 8,494,195 B2
(45) Date of Patent: Jul. 23, 2013

(54) ELECTRICAL CONTACTS USING CONDUCTIVE SILICONE IN HEARING ASSISTANCE DEVICES

(75) Inventor: Sidney A. Higgins, Maple Grove, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 963 days.

(21) Appl. No.: 12/027,173

(22) Filed: Feb. 6, 2008

(65) Prior Publication Data

US 2008/0187157 A1 Aug. 7, 2008

Related U.S. Application Data

(60) Provisional application No. 60/888,724, filed on Feb. 7, 2007.

(51) Int. Cl.
*H04R 25/00* (2006.01)

(52) U.S. Cl.
USPC ..... 381/314; 381/312; 381/331

(58) Field of Classification Search
USPC ..... 381/312–331
See application file for complete search history.

(56) References Cited

U.S. PATENT DOCUMENTS

| | | | | |
|---|---|---|---|---|
| 3,728,509 | A * | 4/1973 | Shimojo | 200/512 |
| 3,812,300 | A | 5/1974 | Brander et al. | |
| 4,017,834 | A | 4/1977 | Cuttill et al. | |
| 4,310,213 | A | 1/1982 | Fetterolf, Sr. et al. | |
| 4,571,464 | A * | 2/1986 | Segero | 381/173 |
| 4,729,166 | A | 3/1988 | Lee et al. | |
| 5,606,621 | A | 2/1997 | Reiter et al. | |
| 5,687,242 | A | 11/1997 | Iburg | |
| 5,755,743 | A | 5/1998 | Volz et al. | |
| 5,824,968 | A | 10/1998 | Packard et al. | |
| 5,987,146 | A | 11/1999 | Pluvinage et al. | |
| 6,766,030 | B1 | 7/2004 | Chojar | |
| 6,876,074 | B2 | 4/2005 | Kim | |
| 7,016,512 | B1 | 3/2006 | Feeley et al. | |
| 7,110,562 | B1 | 9/2006 | Feeley et al. | |
| 7,139,404 | B2 | 11/2006 | Feeley et al. | |
| 7,142,682 | B2 | 11/2006 | Mullenborn et al. | |
| 7,256,747 | B2 | 8/2007 | Victorian et al. | |

(Continued)

FOREIGN PATENT DOCUMENTS

| | | | |
|---|---|---|---|
| DE | 3006235 | A1 | 10/1980 |
| DE | 3643124 | A1 | 7/1988 |

(Continued)

OTHER PUBLICATIONS

"European Application Serial No. 08725262.3, Office Action mailed Apr. 21, 2010", 6 Pgs.

(Continued)

*Primary Examiner* — David Vu
*Assistant Examiner* — Jonathan Han
(74) *Attorney, Agent, or Firm* — Schwegman Lundberg & Woessner, P.A.

(57) ABSTRACT

A hearing assistance device, comprising a microphone to receive sound, signal processing electronics electrically connected to the microphone, a receiver electrically connected to the signal processing electronics and a switch electrically connected to the signal processing electronics, wherein the switch includes conductive silicone adapted to change the switch from a first state to a second state when activated.

19 Claims, 4 Drawing Sheets

U.S. PATENT DOCUMENTS

| | | | | |
|---|---|---|---|---|
| 7,446,720 | B2 | 11/2008 | Victorian et al. | |
| 7,471,182 | B2 | 12/2008 | Kumano et al. | |
| 7,593,538 | B2 | 9/2009 | Polinske | |
| 8,098,863 | B2 | 1/2012 | Ho et al. | |
| 2003/0178247 | A1 | 9/2003 | Saltykov | |
| 2003/0200820 | A1 | 10/2003 | Takad et al. | |
| 2004/0114776 | A1 | 6/2004 | Crawford et al. | |
| 2004/0240693 | A1 | 12/2004 | Rosenthal | |
| 2005/0008178 | A1* | 1/2005 | Joergensen et al. | 381/322 |
| 2006/0097376 | A1 | 5/2006 | Leurs et al. | |
| 2007/0036374 | A1 | 2/2007 | Bauman et al. | |
| 2007/0188289 | A1 | 8/2007 | Kumano et al. | |
| 2008/0003736 | A1 | 1/2008 | Arai et al. | |
| 2008/0026220 | A9 | 1/2008 | Bi et al. | |
| 2008/0199971 | A1 | 8/2008 | Tondra | |
| 2009/0074218 | A1 | 3/2009 | Higgins | |
| 2009/0075083 | A1 | 3/2009 | Bi et al. | |
| 2009/0196444 | A1 | 8/2009 | Solum | |
| 2009/0245558 | A1 | 10/2009 | Spaulding | |
| 2009/0262964 | A1 | 10/2009 | Havenith et al. | |
| 2010/0034410 | A1 | 2/2010 | Link et al. | |
| 2010/0074461 | A1 | 3/2010 | Polinske | |
| 2010/0124346 | A1 | 5/2010 | Higgins | |
| 2010/0158291 | A1 | 6/2010 | Polinske et al. | |
| 2010/0158293 | A1 | 6/2010 | Polinske et al. | |
| 2010/0158295 | A1 | 6/2010 | Polinske et al. | |
| 2012/0014549 | A1 | 1/2012 | Higgins et al. | |

FOREIGN PATENT DOCUMENTS

| | | | |
|---|---|---|---|
| DE | 4005476 | A1 | 7/1991 |
| DE | 9320391 | | 9/1993 |
| DE | 4233813 | C1 | 11/1993 |
| DE | 29801567 | U1 | 5/1998 |
| EP | 0339877 | A3 | 11/1989 |
| EP | 0866637 | A2 | 9/1998 |
| EP | 1065863 | A2 | 1/2001 |
| EP | 1465457 | A2 | 10/2004 |
| EP | 1496530 | A2 | 1/2005 |
| EP | 1811808 | A1 | 7/2007 |
| EP | 1816893 | A1 | 8/2007 |
| EP | 2040343 | A1 | 3/2009 |
| GB | 1298089 | | 11/1972 |
| GB | 1522549 | | 8/1978 |
| JP | 02209967 | A2 | 8/1990 |
| JP | 02288116 | A2 | 11/1990 |
| JP | 09199662 | | 7/1997 |
| WO | WO-2004025990 | A1 | 3/2004 |
| WO | WO-2006094502 | A1 | 9/2006 |
| WO | WO-2007148154 | A1 | 12/2007 |
| WO | WO-2008092265 | A1 | 8/2008 |
| WO | WO-2008097600 | A1 | 8/2008 |
| WO | WO-2008097600 | C1 | 8/2008 |

OTHER PUBLICATIONS

"International Application Serial No. PCT/US2008/001609, Search Report mailed Jun. 19, 2008", 7 pgs.
"International Application Serial No. PCT/US2008/001609, Written Opinion mailed Jun. 19, 2008", 8 pgs.
Buchoff, L S, "Advanced Non-Soldering interconnection", XP 10305250A1, (Apr. 16, 1991), 248-251.
"U.S. Appl. No. 11/857,439, filed Jun. 13, 2011 to Restriction Requirement mailed May 11, 2011", 8 pgs.
"U.S. Appl. No. 11/857,439, Restriction Requirement Action mailed May 11, 2011", 6 pgs.
"European Application Serial No. 08253065.0, European Office Action mailed Aug. 26, 2010", 6 Pgs.
"European Application Serial No. 08253065.0, Extended Search Report Mailed Dec. 15, 2008", 9 pgs.
"European Application Serial No. 08253065.0, Office Action mailed Jul. 17, 2009", 1 pg.
"European Application Serial No. 08253065.0, Response to Office Action filed Feb. 28, 2011 to European Office Action mailed Aug. 26, 2010", 17 pgs.
"European Application Serial No. 09168844.0, Office Action Response Filed: Nov. 15, 2010", 8 pgs.
"European Application Serial No. 09250729.2, Extended Search Report Mailed Dec. 14, 2009", 4 pgs.
"International Application Serial No. PCT/US2008/001609, International Preliminary Report on Patentability mailed Aug. 20, 2009", 10 pgs.
"U.S. Appl. No. 11/857,439, Non Final Office Action mailed Aug. 17, 2011", 16 pgs.
"U.S. Appl. No. 12/548,051, Non Final Office Action mailed Oct. 12, 2011", 11 pgs.
"European Application Serial No. 08725262.3, Office Action mailed Aug. 5, 2011", 5 pgs.
"European Application Serial No. 09168844.0, Office Action mailed Apr. 28, 2011", 5 pgs.
"U.S. Appl. No. 11/857,439 , filed Dec. 17, 2011 to Non Final Office Action mailed Aug. 17, 2011", 12 pgs.
"U.S. Appl. No. 11/857,439, Final Office Action mailed Feb. 29, 2012", 16 pgs.
"U.S. Appl. No. 11/857,439, Notice of Allowance mailed May 30, 2012", 9 pgs.
"U.S. Appl. No. 11/857,439, filed Apr. 30, 2012 to Final Office Action mailed Feb. 29, 2012", 9 pgs.
"U.S. Appl. No. 12/548,051, filed Jan. 12, 2012 to Non Final Office Action mailed Oct. 12, 2011", 9 pgs.
"U.S. Appl. No. 12/548,051,Final Office Action mailed Apr. 19, 2012", 12 pgs.
"European Application Serial No. 08725262.3, Response filed Feb. 13, 2012 to Office Action mailed Aug. 5, 2011", 11 pgs.
"European Application Serial No. 09168844.0, Response filed Feb. 24, 2012 to Office Action mailed Apr. 28, 2011", 12 pgs.
"European Application Serial No. 08725262.3, Office Action Response Filed Nov. 2, 2010", 14 pgs.
"European Application Serial No. 09168844.0, European Search Report mailed Apr. 19, 2010", 3 Pgs.
"European Application Serial No. 09168844.0, Office Action mailed May 3, 2010", 5 pgs.
Tondra, Mark, "U.S. Appl. No. 60/887,609, filed Feb. 1, 2007", 28 pgs.

* cited by examiner

ELECTRICAL CONTACTS USING CONDUCTIVE SILICONE IN HEARING ASSISTANCE DEVICES

CLAIM OF PRIORITY AND RELATED APPLICATION

This application claims the benefit under 35 U.S.C. 119(e) of U.S. Provisional Patent Application Ser. No. 60/888,724, filed Feb. 7, 2007, the entire disclosure of which is hereby incorporated by reference in its entirety.

TECHNICAL FIELD

This document relates generally to hearing assistance devices and more particularly to electrical contacts using conductive silicone in hearing assistance devices.

BACKGROUND

Hearing assistance devices have a variety of design and packaging issues. Components are increasingly small in size and require One type of hearing assistance device is a hearing aid. Hearing aids include in-the-ear (ITE), in-the-canal (ITC), completely-in-the-canal (CIC) and behind-the-ear (BTE) designs. Each of these types of hearing aid has its benefits and technical challenges. Generally speaking, CIC designs are placed entirely in the canal and do not rely on manually accessible controls for operation, but are almost impossible to see from the perspective of another casual observer. On the other hand, BTE designs are much more visible and have controls which are readily manually accessible by the user, since the BTE rests on the back side of the ear. In BTE designs conventional switches may be employed, however such switches can fail due to wear and tear or can get dirty, thereby decreasing product benefit and lifetime.

Other tradeoffs in packaging and performance exist. For example, a number of electrical connections are made in such devices, and the room with which a manufacturer has to work with is more limited as device sizes decrease. Device components are typically soldered together, but such connections are prone to failure over time and with extended use of the hearing assistance devices.

SUMMARY

Various embodiments described herein relate to solderless connections and contacts for hearing assistance devices comprising a microphone to receive sound, signal processing electronics electrically connected to the microphone, a receiver electrically connected to the signal processing electronics; and a switch electrically connected to the signal processing electronics, the switch including conductive silicone adapted to change the switch from a first state to a second state when activated. Various embodiments also include hearings assistance devices comprising a microphone to receive sound, signal processing electronics electrically connected to the microphone, a receiver electrically connected to the signal processing electronics and at least one contact comprising conductive silicone for electrically connecting at least one electrical component to the signal processing electronics. Various embodiments include hearing assistance devices for wearing behind the ear, in the ear, in the canal and completely in the canal.

This Summary is an overview of some of the teachings of the present application and is not intended to be an exclusive or exhaustive treatment of the present subject matter. Further details about the present subject matter are found in the detailed description and the appended claims. The scope of the present invention is defined by the appended claims and their legal equivalents.

DETAILED DESCRIPTION

The following description includes examples which demonstrate only some of the embodiments of the present invention. The following description and drawings provide examples for illustration, and are not intended to provide an exhaustive treatment of all possible implementations. It should be noted that references to "an", "one", or "various" embodiments in this disclosure are not necessarily to the same embodiment, and such references contemplate more than one embodiment.

Figure 1:
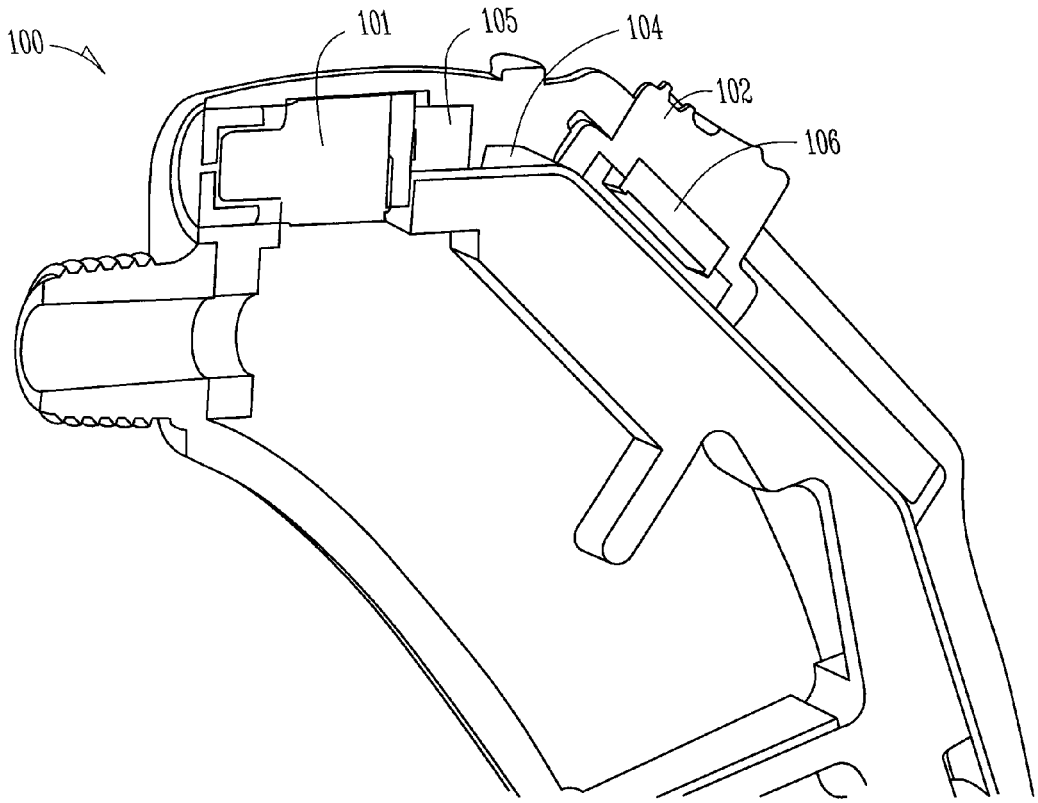
FIG. 1 is a cross section of a hearing assistance device having a switch using conductive silicone according to one embodiment of the present subject matter.

FIG. 1 is a cross section of a hearing assistance device 100 having a switch using conductive silicone according to one embodiment of the present subject matter. In various embodiments, a hearing assistance device has at least one pushbutton for manually selecting and/or adjusting operation parameters of the device. In the embodiment of FIG. 1, the pushbutton 102 uses conductive silicone 106 instead of traditional mechanical contact schemes for providing a contact associated with the pushbutton. The pushbutton is shown in an open state. As the button is pressed, the conductive silicone 106 contacts the circuit board 104. In various embodiments, the conductive silicone 106 engages exposed terminations on the circuit board, thus closing a circuit. In various embodiments, the circuit is connected to a processor and can provide an input signal to the processor, for example, to select a parameter for adjustment and/or to change the volume of the hearing assistance device. In various embodiments, a barrier skirt is included around the conductive silicon to prevent contaminates from settling on the conductive traces of the circuit board. In the example of FIG. 1, pushbutton 102 includes a portion 111 that remains in contact with the circuit board at all times. This portion of the pushbutton functions as a barrier skirt 111 to protect the circuit board 104, the exposed traces and the conductive silicone 106 from contaminants. The barrier skirt 111 of pushbutton 102 completely surrounds the interface between the circuit board 104 and the conductive silicon 106. In various embodiments, the pushbutton 102 and barrier skirt 111 are formed from the same material and are bonded to the conductive silicon using various over-molding processes. Nonconductive silicone is an example of a material that may be used to form the pushbutton and barrier skirt.

Figure 2A:
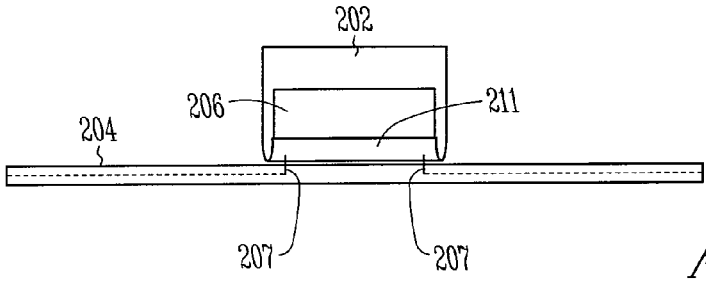
FIG. 2A is a side view of one example of a conductive switch using conductive silicone in a first state according to one embodiment of the present subject matter.
Figure 2B:
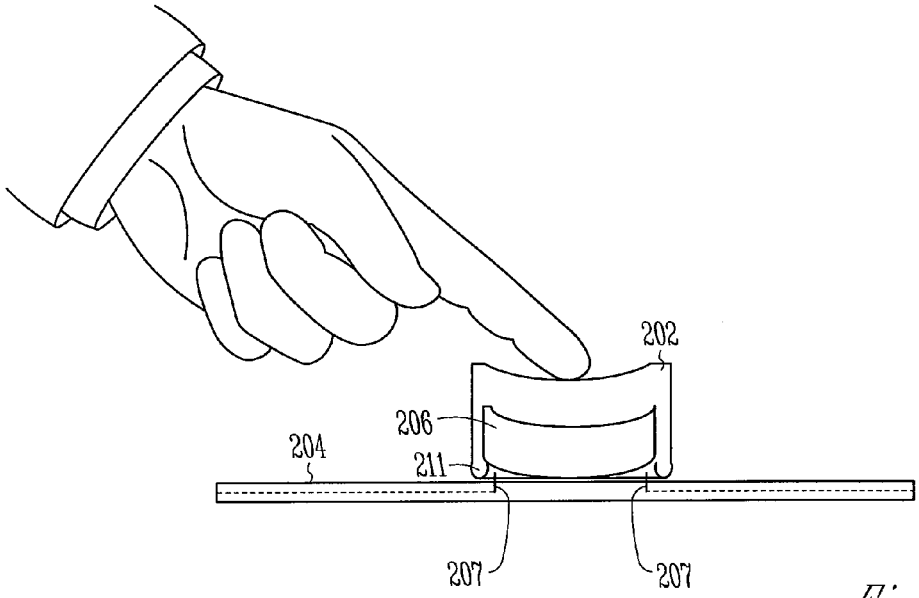
FIG. 2B is a side view of one example of a conductive switch using conductive silicone in a second state according to one embodiment of the present subject matter.

FIG. 2A is a side cutaway view of one example of a pushbutton switch using conductive silicone in a first state according to one embodiment of the present subject matter. FIG. 2B is a side cutaway view of one example of a pushbutton switch using conductive silicone in a second state according to one embodiment of the present subject matter. FIGS. 2A and 2B illustrate the use of conductive silicon to close a circuit in a pushbutton switch assembly. FIGS. 2A and 2B show a circuit board 204, circuit traces 207, conductive silicon 206 and a pushbutton body 202 including a barrier skirt 211. In the example illustrated, the circuit traces form a switchable set of contacts that may be connected to the processor or other electronics of a hearing assistance device. In FIG. 2A, the switch is shown as being electrically "open." FIG. 2B, illustrates a switch in an electrically "closed" state by application of a force to the layer of conductive silicone. The force has two effects in this example, the first effect is to deform the switch body and barrier skirt such that the conductive silicon is squeezed between the pushbutton body and the circuit board (lowering the impedance of the conductive silicone in the zone of applied pressure). The force has a second effect of engaging the conductive silicon into contact with a complimentary pair of exposed circuit board traces. The low impedance of the conductive silicon closes the circuit connected to the exposed traces. It is understood that normally closed switches can be formed using the conductive silicone, and that the example given here is not restricted to normally open embodiments.

Figure 2C:
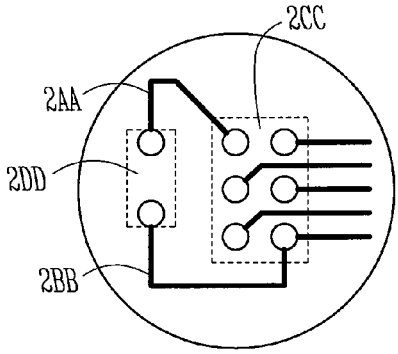
FIG. 2C is a plan view of one example of circuit traces for which the conductive silicone forms a conductive bridge when pressed to form a switch according to one embodiment of the present subject matter.

FIG. 2C is a plan view of one example of circuit traces for which the conductive silicone forms a conductive bridge when pressed to form a switch according to one embodiment of the present subject matter. The printed circuit traces 2AA and 2BB are connected to electronics 2CC which sense when a relatively low impedance is presented across the traces by conductive silicone 2DD as it is depressed in the switching process. It is understood that other configurations of traces, dimensions of traces, numbers of traces, and trace conducting materials may be employed without departing from the scope of the present subject matter.

Figure 3:
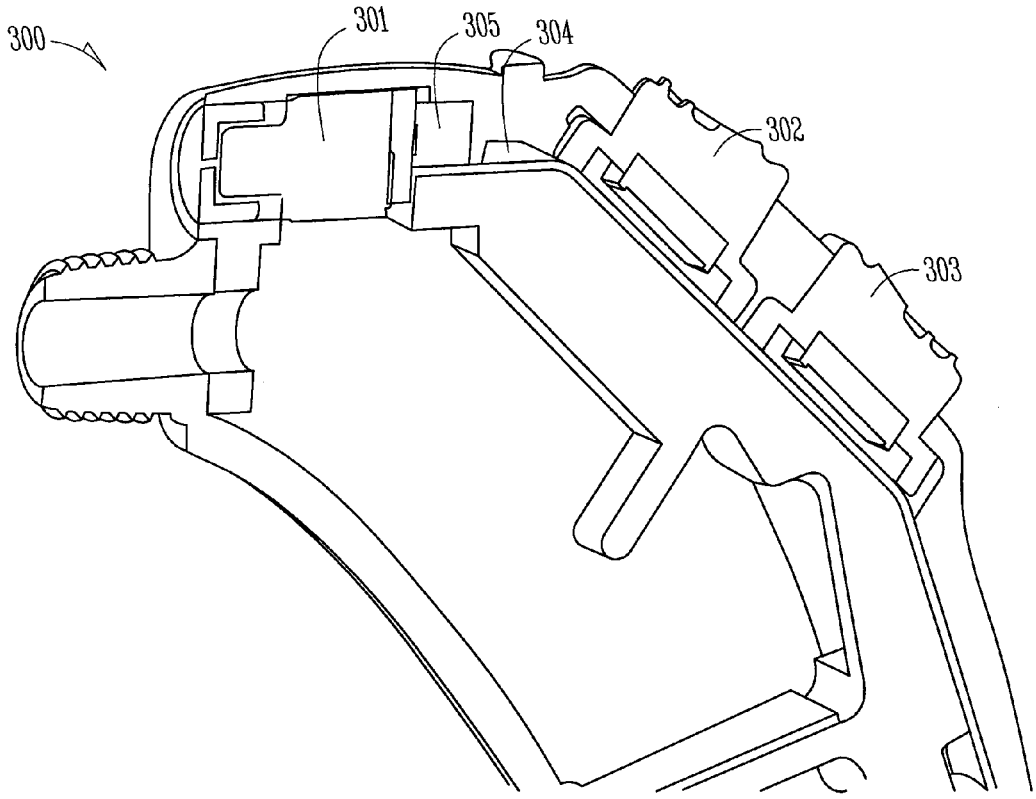
FIG. 3 is a cross section of a hearing assistance device having a plurality of switches using conductive silicone according to one embodiment of the present subject matter.

FIG. 3 is a cross section of a hearing assistance device having a plurality of switches using conductive silicone according to one embodiment of the present subject matter. The figure shows a cutaway view of a hearing assistance device 300. The hearing assistance device includes a transducer 301, a first pushbutton 302 and a second pushbutton 303. In various embodiments, the transducer 301 is connected to a circuit board 304 by conductive silicone 305. The conductive silicone 305, takes the place of solder. In various embodiments, the conductive silicone eliminates the need to solder transducers where conductive silicone can be sized and installed between electrical terminals of the transducer and the corresponding electrical terminations on the circuit board.

Figure 4:
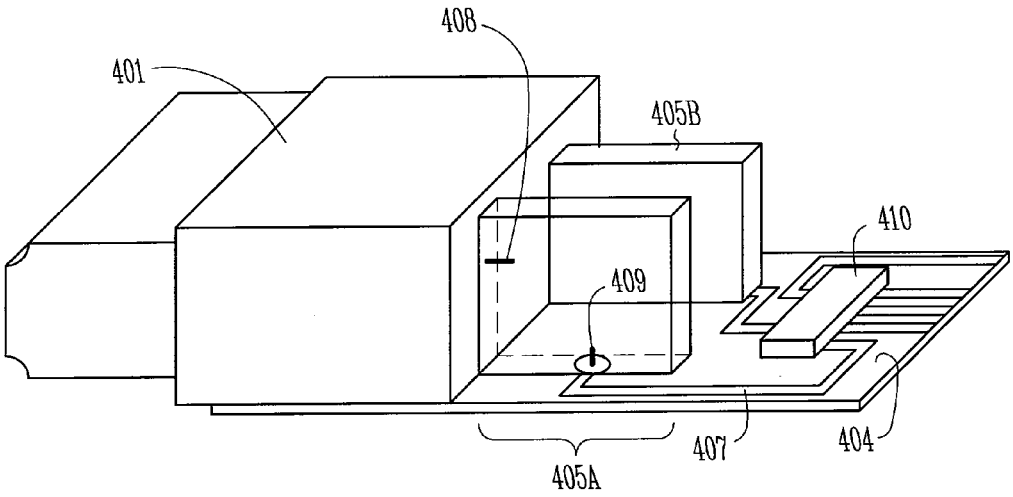
FIGS. 4 and 5 are perspective views of a portion of a hearing assistance device having contacts for components including conductive silicone according to various embodiments of the present subject matter.

FIG. 4 is a perspective view of a portion of a hearing assistance device having conductive silicone contacts for components according to one embodiment of the present subject matter. The perspective view includes a transducer 401, a circuit board 404, conductive silicon contacts 405A, 405B and additional electronics 410. In various embodiments, the conductive silicon contacts 405A, 405B are adapted to provide a low resistance contact between the terminals of the transducer 408 and the corresponding terminals 409 and traces 407 of the circuit board 404. The low resistance contact facilitates the transfer of the electrical signal of the transducer 401 to other electronics 410 of the hearing assistance device.

Figure 5:
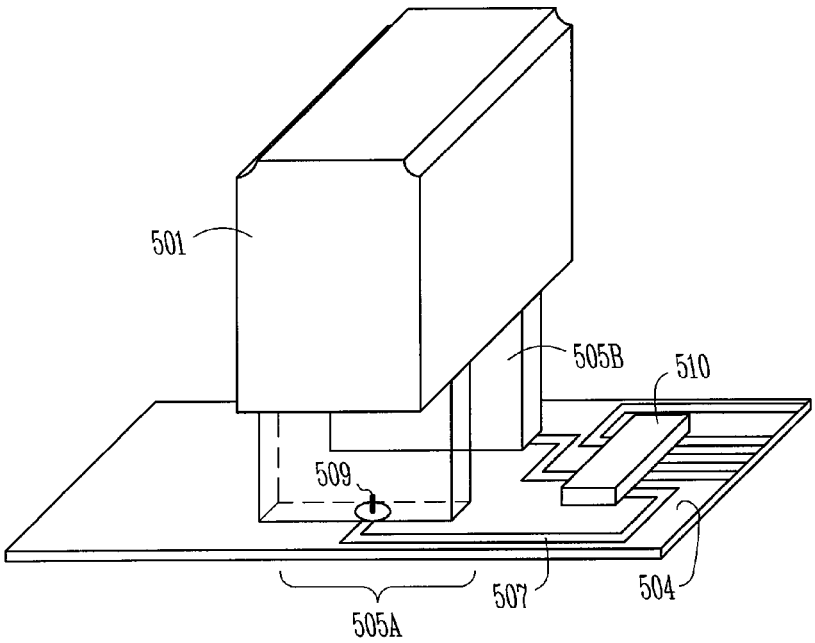

FIG. 5 is a perspective view of a portion of a hearing assistance device having conductive silicone contacts for components according to one embodiment of the present subject matter. The perspective view includes a transducer 501, a circuit board 504, conductive silicon contacts 505A, 505B and additional electronics 510. In various embodiments, the conductive silicon contacts 505A, 505B are adapted to provide a low resistance contact between the terminals of the transducer, not shown, and the corresponding terminals 509 and traces 507 of the circuit board 504. The low resistance contact facilitates the transfer of the electrical signal of the transducer 501 to other electronics 510 of the hearing assistance device. In various embodiments, the conductive silicon can be sized and shaped to accommodate unique, individual terminal configurations, as well as, multiple terminal arrangements.

An example of conductive silicone used in the features of the present subject matter include, but are not limited to, STAX™ Elastomeric Connectors manufactured and distributed through Tyco/Electronics.

This application is intended to cover adaptations and variations of the present subject matter. It is to be understood that the above description is intended to be illustrative, and not restrictive. The scope of the present subject matter should be determined with reference to the appended claim, along with the full scope of legal equivalents to which the claims are entitled.

What is claimed is:

1. A hearing assistance device, comprising:

a microphone to receive sound;

signal processing electronics mounted on a circuit board;

a receiver; and conductive silicon installed between terminals of the microphone and terminals on the circuit board to electrically connect the microphone to the signal processing electronics and wherein the conductive silicon is applied to provide a solder-like mechanical connection between the terminals of the microphone and the terminals on the circuit board.

2. The hearing assistance device of claim 1, further comprising a switch electrically connected to the signal processing electronics, the switch including conductive silicone adapted to change the switch from a first state to a second state when activated, wherein the switch includes a barrier skirt adapted to isolate an interface between the conductive silicon and the signal processing electronics from contamination.

3. The hearing assistance device of claim 2, wherein the switch and the second switch comprise a common layer of conductive silicone.

4. The hearing assistance device of claim 1, further comprising conductive silicon installed between terminals of the receiver and terminals on the circuit board to connect the receiver to the signal processing electronics.

5. The hearing assistance device of claim 1, wherein the hearing assistance device is a behind-the-ear hearing aid.

6. The hearing assistance device of claim 1, wherein the hearing assistance device is an in-the-ear hearing aid.

7. The hearing assistance device of claim 1, wherein the hearing assistance device is an in-the-canal hearing aid.

8. The hearing assistance device of claim 1, wherein the hearing assistance device is a completely-in-the-canal hearing aid.

9. A hearing assistance device, comprising:

a housing;

signal processing electronics enclosed in the housing and mounted on a circuit board;

an acoustic transducer adapted to be worn in a user's ear canal; and conductive silicon installed between terminals of the acoustic transducer and terminals on the circuit board to electrically connect the transducer to the signal processing electronics and wherein the conductive silicon is applied to provide a solder-like mechanical connection between the terminals of the acoustic transducer and the terminals on the circuit board.

10. The hearing assistance device of claim 9, further comprising a switch electrically connected to the signal processing electronics, the switch including conductive silicone adapted to change the switch from a first state to a second state when activated.

11. The hearing assistance device of claim 10, further comprising a second switch electrically connected to the signal processing electronics, the second switch including conductive silicone configured to change the second switch from a first state to a second state when activated.

12. The hearing assistance device of claim 11, wherein the switch and the second switch comprise a common layer of conductive silicone.

13. The hearing assistance device of claim 9, further comprising a microphone connected to the signal processing electronics.

14. The hearing assistance device of claim 9, further comprising one or more contacts comprising conductive silicone connecting the microphone to the signal processing electronics.

15. The hearing assistance device of claim 9, wherein the housing is a behind-the-ear housing.

16. The hearing assistance device of claim 9, wherein the housing is an in-the-ear hearing housing.

17. The hearing assistance device of claim 9, wherein the housing is an in-the-canal housing.

18. The hearing assistance device of claim 9, wherein the housing is a completely-in-the-canal housing.

19. A hearing assistance device, comprising:

a microphone to receive sound;

signal processing electronics mounted on a circuit board;

a receiver; and conductive silicon installed between terminals of the receiver and terminals on the circuit board to electrically connect the receiver to the signal processing electronics and wherein the conductive silicon is applied to provide a solder-like mechanical connection between the terminals of the receiver and the terminals on the circuit board.

* * * * *